US010281224B2

(12) United States Patent
Hetzer et al.

(10) Patent No.: US 10,281,224 B2
(45) Date of Patent: May 7, 2019

(54) HEAT EXCHANGER

(71) Applicant: ARVOS GMBH, Kassel (DE)

(72) Inventors: Jens Hetzer, Kassel (DE); Aitzol Inchaurbe, Kassel (DE); Volker Paruch, Kassel (DE); Klaus Rothenpieler, Kassel (DE); Karsten Stückrath, Vellmar (DE); Jörg Weidenfeller, Fuldatal (DE)

(73) Assignee: ARVOS GMBH, Kassel (DE)

( * ) Notice: Subject to any disclaimer, the term of this patent is extended or adjusted under 35 U.S.C. 154(b) by 0 days.

(21) Appl. No.: 15/739,830

(22) PCT Filed: Jun. 3, 2016

(86) PCT No.: PCT/EP2016/062643
§ 371 (c)(1),
(2) Date: Dec. 26, 2017

(87) PCT Pub. No.: WO2017/001147
PCT Pub. Date: Jan. 5, 2017

(65) Prior Publication Data

US 2018/0187988 A1 Jul. 5, 2018

(30) Foreign Application Priority Data

Jul. 2, 2015 (DE) ..... 10 2015 212 433

(51) Int. Cl.
*F28F 27/02* (2006.01)
*F28F 9/02* (2006.01)
*F28D 7/12* (2006.01)

(52) U.S. Cl.
CPC ..... *F28F 27/02* (2013.01); *F28D 7/12* (2013.01); *F28F 9/0229* (2013.01); *F28F 2250/06* (2013.01)

(58) Field of Classification Search
CPC ..... F28F 27/02; F28F 2250/06; F28F 9/0229; F28D 7/12; F28D 1/05325; F28D 1/0233; B60H 1/00335; B60H 1/00735
(Continued)

(56) References Cited

U.S. PATENT DOCUMENTS 2,475,025 A 7/1949 Huff
4,993,367 A 2/1991 Kehrer
(Continued)

FOREIGN PATENT DOCUMENTS

CN 102313482 A 1/2012
DE 3828034 A1 2/1990
(Continued)

OTHER PUBLICATIONS

International Search Report dated Sep. 15, 2016 from corresponding International Application No. PCT/EP2016/062643 ( 5 pages).
(Continued)

*Primary Examiner* — Davis D Hwu
(74) *Attorney, Agent, or Firm* — Maier & Maier, PLLC

(57) ABSTRACT

A heat exchanger having a first section, through which a first medium can flow, and a second section, through which a second medium can flow. During operation a heat exchange takes place between the first and the second medium. The first section has an inlet chamber and first tubes connected to the inlet chamber, and an outlet chamber and second tubes connected to the outlet chamber. The first tubes are each closed at the ends facing away from the inlet chamber and each second tube is at least partly arranged inside one of the first tubes, and the end of the second tube that faces away from the outlet chamber is open to the interior of the respective first tube. The second section has an inlet means and an outlet means.

15 Claims, 3 Drawing Sheets

Figure 1:
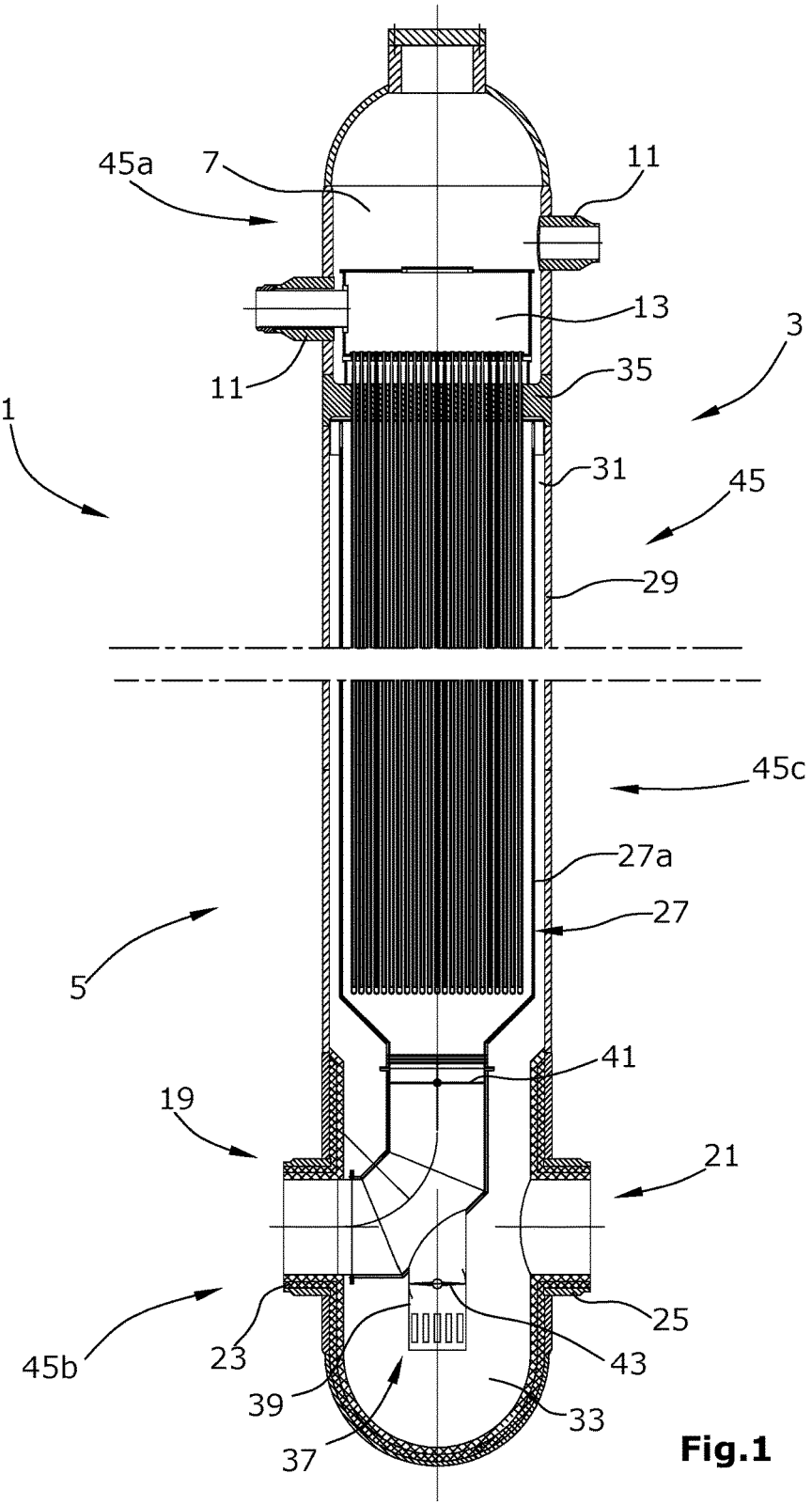

(58) Field of Classification Search
USPC ..... 165/103
See application file for complete search history.

(56) References Cited

U.S. PATENT DOCUMENTS

| | | | | |
|---|---|---|---|---|
| 5,915,465 | A | 6/1999 | Fix et al. | |
| 2010/0254891 | A1 | 10/2010 | Giroudiere | |
| 2012/0145367 | A1 | 6/2012 | Fujisawa et al. | |
| 2013/0283835 | A1* | 10/2013 | Katoh ..... | B60H 1/00328 62/180 |

FOREIGN PATENT DOCUMENTS

| | | | |
|---|---|---|---|
| EP | 035648 | A1 | 3/1990 |
| GB | 375132 | A | 6/1932 |
| JP | H11217573 | A | 8/1999 |

OTHER PUBLICATIONS

PCT Written Opinion dated Sep. 15, 2016 from corresponding International Application No. PCT/EP2016/062643 ( 5 pages).
Office Action dated Dec. 14, 2018 in corresponding Chinese Application No. 201680039411.9; 11 pages including English-language translation.

* cited by examiner

HEAT EXCHANGER

FIELD

The present invention relates to a heat exchanger.

BACKGROUND

For transferring heat energy from one process medium to a second process medium, use is made of heat exchangers. In recuperative heat exchangers, each medium has a space that is separated from the other medium.

A widespread design of heat exchangers consists of so-called tube-bundle heat exchangers wherein a medium is conducted through a plurality of parallel tubes arranged in a bundle. The second medium is conducted through a chamber surrounding the tube bundle.

According to a special design, the tube bundle is formed by a plurality of tubes that are closed on one side. These tubes have a second tube inserted into them that is open toward the closed end of the first tube. A design of this type is known from US 2010/0254891 A1. Since, for improved convenience of connection, the inner tubes are often guided laterally out from the inner tube, this design is often referred to as a bayonet-type heat exchanger.

This design offers the advantage that the medium, mostly flowing back in the inner tube, will transmit a part of the thermal energy to the medium flowing by on the outside and thus will contribute to the heating of the inflowing cooler medium.

In heat exchangers of this type, however, problems are encountered in the realization of an advantageous control, and further problems may occur when the system must be switched off urgently, e.g. when the to-be-heated medium is exposed to an excessive temperature.

Thus, it is an object of the invention to provide a heat exchanger of the initially mentioned type wherein a switch-off of the heat transmission is possible in an advantageous manner. Further, preferably, an advantageous control of the heat exchanger should be possible.

SUMMARY

In a heat exchanger according to the invention, comprising a first section through which a first medium can flow, and a second section through which a second medium can flow, wherein during operation a heat exchange takes place between the first and the second medium, the first section comprises an inlet chamber and first tubes connected to the inlet chamber, and an outlet chamber and second tubes connected to the outlet chamber. The first tubes are each closed at the end facing away from the inlet chamber, and each second tube is at least partly arranged inside one of the first tubes. The end of each second tube that faces away from the outlet chamber is open toward the interior of the respective first tube. The second section comprises an inlet means and an outlet means, wherein the inlet means opens into a heat exchanger chamber. The heat exchanger chamber at least partly surrounds the first tubes of the first section. Further, the heat exchanger chamber is connected to the outlet means. The invention is characterized in that the inlet means comprises a shut-off device for shutting off the fluid flow of the second medium into the heat exchanger chamber, and that a bypass device connects the inlet means and the outlet means in a manner leading the fluid flow of the second medium at least partly past the heat exchanger chamber, wherein the shut-off device is arranged downstream of the bypass device when viewed in the flow direction of the second medium.

Thus, with the aid of the shut-off device in its shut-off position, it can be prevented in an advantageous manner that second medium which is inflowing via the inlet means might enter the heat exchanger chamber. By means of the bypass device, the second medium can be conducted directly to the outlet device. In the shut-off state of the shut-off device, the heat exchanger chamber has no flow passing through it. Thus, with the aid of the shut-off device, a quick shut-off of the heat transfer between the first and the second medium is rendered possible, while, since the second medium can be discharged via the bypass device, it is prevented at the same time that a too high pressure might be generated at the shut-off device.

The first tubes of the first section are preferably arranged in parallel and as a bundle.

Preferably, it is provided that the bypass device comprises a control device for control of the fluid flow of the second medium through the bypass device. The control device can be realized e.g. as a rotatingly driven flap. Flaps of this type have the benefit that a drive shaft for operating the flap can be sealed in an advantageous manner. This makes it possible, in the opened state of the shut-off device, to select whether a specific portion of the second medium is to be conducted through the bypass device, which is performed by setting the pressure loss in the bypass device with the aid of the control device. Thus, the quantity of the second medium that enters the heat exchanger chamber and accordingly will effect a heat exchange with the first medium, can be controlled in an advantageous manner.

Preferably, it is provided that the shut-off device has a control function. In this manner, the quantity of the second medium that is to enter the heat exchanger chamber can be controlled also by means of the shut-off device. In an embodiment wherein the bypass device has no control device, said shut-off device with control function can also be used for setting that a part of the second medium will be conducted through the bypass device and thus past a heat exchanger chamber.

The bypass device and the shut-off device are generally formed separately from each other and operable independently from each other. This allows to achieve a particularly flexible use and an advantageous control because, in the entire operating range, there exists a defined control curve. The shut-off device can comprise e.g. a flap operable in a rotary manner and provided for control of the throughflow.

Preferably, it is provided that the heat exchanger chamber is formed by an elongated tube. This makes it possible, by use of a simple construction, to provide a heat exchanger chamber accommodating a tube bundle of first tubes.

Preferably, it is provided herein that a casing tube surrounds the elongated tube of the heat exchanger chamber and that the outlet means opens into the casing tube, wherein, on the side facing away from the inlet means, the elongated tube is open toward a gap space formed between the casing tube and the elongated tube. In other words: At the end of the elongated tube, the second medium flowing through the heat exchanger chamber will flow to the outside into the annular gap formed between the casing tube and the elongated tube and, outside, will flow on the elongated tube back in the direction toward the outlet means. In this manner, it can be effected e.g. that the outlet means and the inlet means are arranged relatively closely to each other so that the feed and discharge tubes for the second medium can be arranged in close proximity, which often has constructional advantages.

Preferably, the heat exchanger comprises a casing in which the inlet chamber, the outlet chamber and the heat exchanger chamber are accommodated. In other words: The heat exchanger comprises a common casing for at least a part of the several apparatus forming the first and the second section.

It can be provided that the casing forms the casing tube.

The heat exchanger can e.g. have an elongated configuration, wherein the inlet chamber is e.g. surrounded by the casing wall. The outlet chamber can e.g. be inserted in the inlet chamber. For example, the outlet chamber can be separated against the heat exchanger chamber and the casing tube by a casing separating wall having the first and second tubes passing through it. Such a design has proven to be particularly advantageous.

It can be provided that the inlet chamber and the outlet chamber are arranged in a first end section of the casing. The first end section is understood to be e.g. a portion of the casing that extends along 10-20% of the length of the casing.

The inlet means and the outlet means can be arranged on a second end section of the casing. Also the second end section can extend along 10-20% of the length of the casing.

The heat exchanger chamber can be arranged in a central section of the casing. The central section of the casing is arranged between the first and the second end section.

Preferably, it is provided that the inlet means comprises an inlet tube connector and the outlet means comprises an outlet tube connector, said connectors being arranged in a horizontal plane. In other words: The central axes of the inlet tube connector and the outlet tube connector are arranged in one plane. The inlet and outlet tube connectors can be arranged e.g. coaxially or, however, by offset from each other by 90°.

Such an arrangement is of particular advantage since the conduits conducting the second medium that lead toward the heat exchanger and away from it, can also be arranged coaxially to each other. Thus, the heat exchanger of the invention is e.g. suited to be inserted into an existing conduit of the second medium without large technical expenditure.

According to a particularly preferred embodiment of the invention, it is provided that the outlet means comprises a second outlet chamber, wherein the inlet means traverses the second outlet chamber and wherein the bypass device comprises a bypass tube connector extending from the inlet means into the second outlet chamber. The second outlet chamber can be formed e.g. by the second end section of the casing.

Such a design of the inlet means and the outlet means can be realized, under the constructional aspect, in a particularly simple manner.

Preferably, it is provided that the outlet tube connector opens into the second outlet chamber.

In the heat exchanger of the invention, the shut-off device and the control device of the bypass device can be designed e.g. as flaps. Of course, also other kinds of control members can be used.

According to a preferred embodiment of the invention, it is provided that each second tube is designed as a double-walled tube comprising an inner tube and an outer tube, wherein the inner tube and the outer tube are connected to each other on the end facing away from the outlet chamber or on the end facing toward the outlet chamber. Thereby, it is effected that medium entering the inlet chamber will be accumulated in the annular gap formed between the inner tube and the outer tube. The outer tube of the second tube is effective as a radiation shield against heat radiation of the to-be-heated medium. Further, the medium existent in the annular gap between the outer tube and the inner tube can achieve an insulation effect.

Preferably, it is provided that, in the heat exchanger chamber, flow deflection elements are arranged for deflecting the flow of the second medium.

The provision of flow deflection elements in the heat exchanger chamber can advantageously provide for a forced guidance of the second medium. Thereby, the heat exchange in the heat exchanger chamber can be enhanced. By the forced guidance of the second medium, it is also rendered possible to reduce the amount of pressure loss of the pressure of the second medium during its passage through the heat exchanger chamber.

The heat exchanger of the invention can be operated by gases, vapors and liquids in any desired combination and be used e.g. as a gas-gas heat exchanger or gas-liquid heat exchanger. Further, it is possible that a heat exchange takes place between a gaseous medium and a hydraulic medium. The medium 1 can be e.g. smoke and the medium 2 can be a hydraulic medium such as e.g. water. Further, the possibility exists that the medium 1 is a hydraulic medium such as e.g. water and the medium 2 is smoke. In the heat exchanger of the invention, the medium 1 can be a medium provided to be heated and the medium 2 can be a medium provided to be cooled or, conversely, the medium 2 can be a medium provided to be heated and the medium 1 can be a medium provided to be cooled.

BRIEF DESCRIPTION

The invention will be explained in greater detail hereunder with reference to the accompanying Figures.

In the Figures

Figure 2:
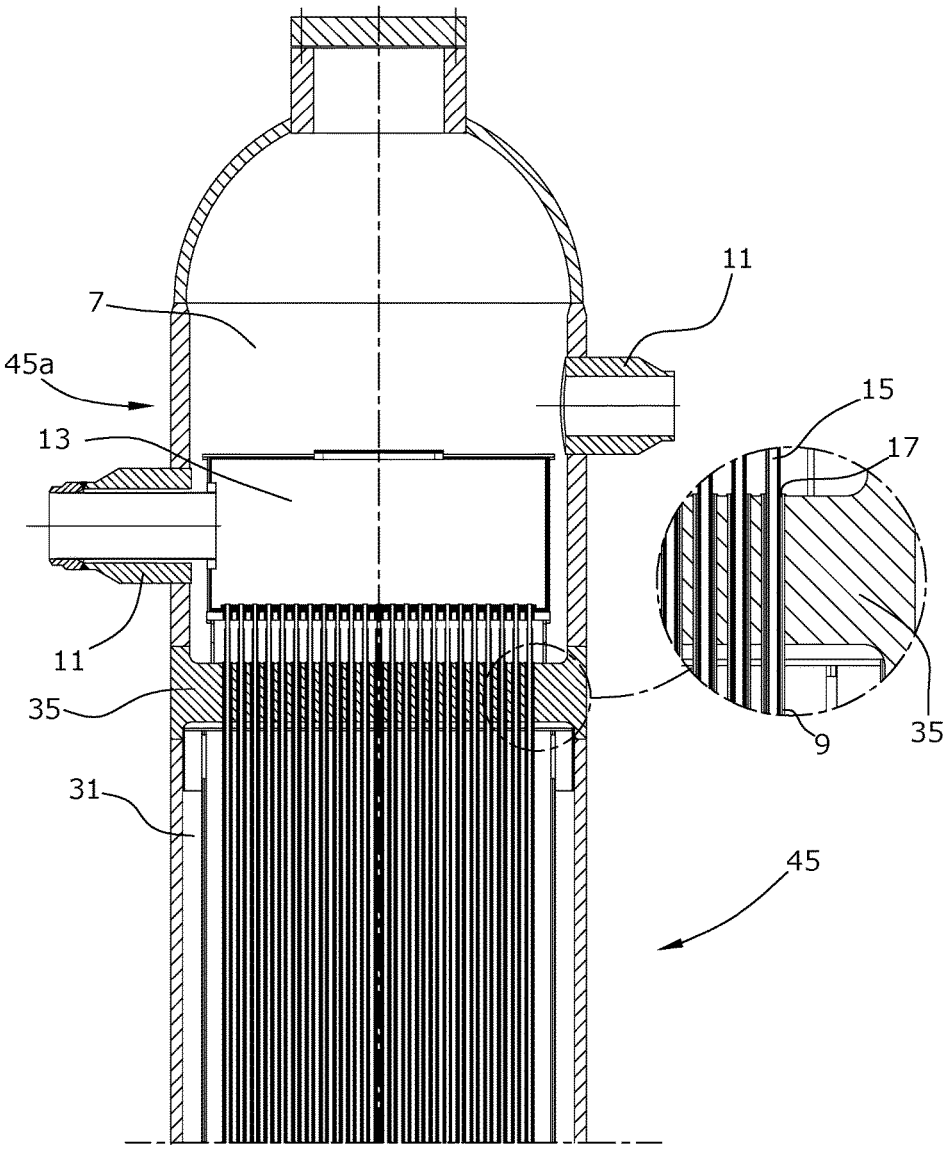
Figure 3:
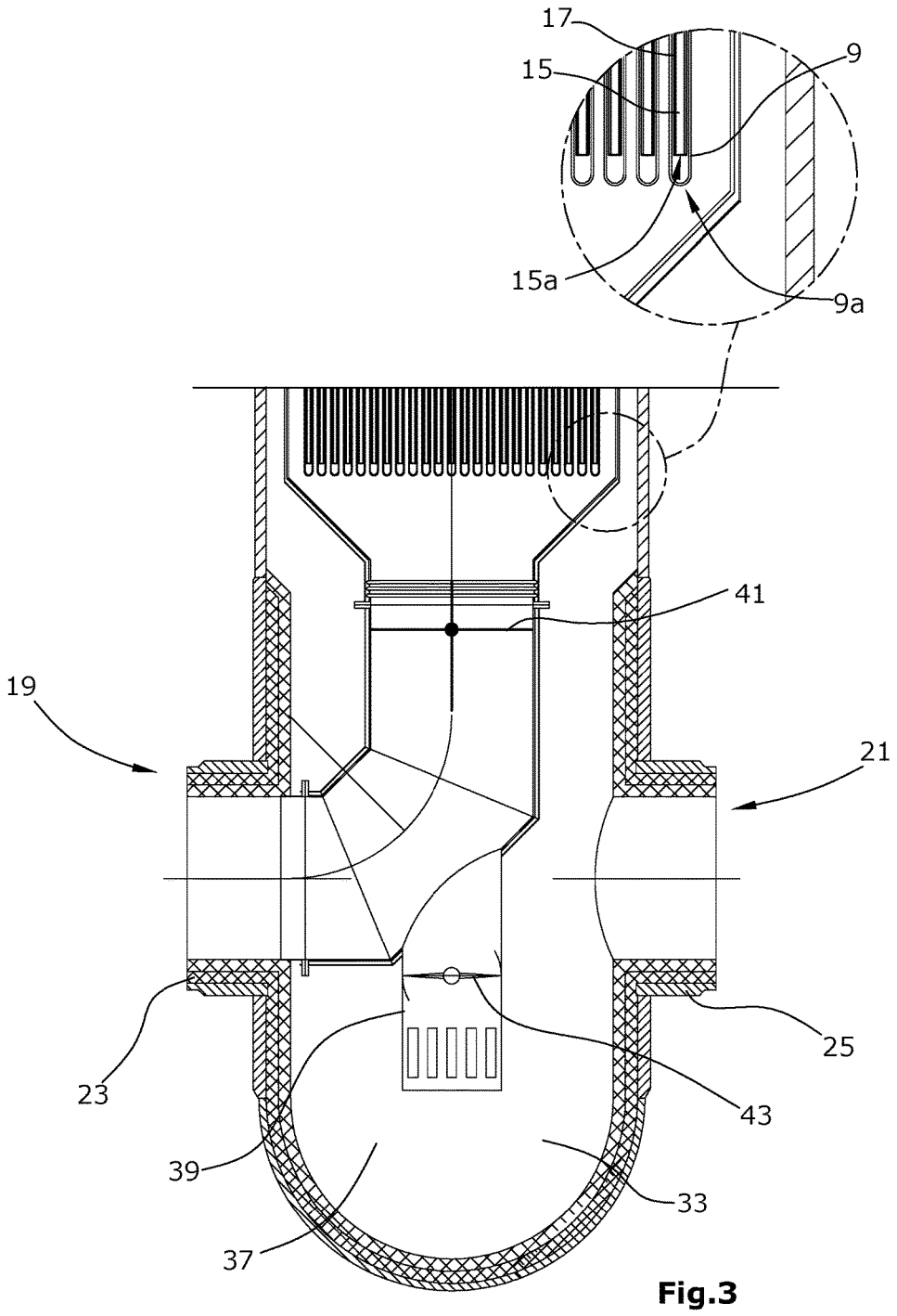

FIG. 1 is a schematic sectional view of a heat exchanger according to the invention, FIG. 2 is a schematic detailed view of the first end section of the casing of the heat exchanger shown in FIG. 1, and FIG. 3 is a schematic detailed view of the second end section of the casing of the heat exchanger shown in FIG. 1.

DETAILED DESCRIPTION

In FIGS. 1-3, a heat exchanger 1 according to the invention is schematically shown in sectional view.

The heat exchanger 1 consists of a first section 3 adapted for through flow of a first medium, and a second section 5 adapted for through flow of a second medium.

In operation of heat exchanger 1, a heat exchange occurs between the first and the second medium.

The first section 3 of heat exchanger 1 comprises a an inlet chamber 7 and first tubes 9 connected to the inlet chamber. Via a tube connector 11, the first medium can be conducted into inlet chamber 7. On an end 9*a* facing away from inlet chamber 7, the tubes 9 are closed. The first tubes 9 are parallel to each other and are arranged as tube bundle.

Further, the first section 3 comprises an outlet chamber 13 connected to a further tube connector 11 through which the first medium can be discharged from the heat exchanger 1.

The outlet chamber 13 is arranged in the inlet chamber 7 and connected to a plurality of second tubes 15. Each second tube 15 is partly arranged within one of the first tubes 9. In other words: A second tube 15 is inserted into a first tube 9.

The end 15*a* of each second tube 15 facing away from outlet chamber 13 is open toward the interior of the respective first tube 9.

Via tube connector 11, the first medium flowing through the first section 3 will enter the inlet chamber 7. From there, the medium will flow in the annular gap 17 formed between the first tube 9 and each second tube 15, until reaching the end 9*a* of each tube 9 facing away from inlet chamber 7. Since the first tubes 9 are closed on this end, the first medium will flow into the second tube 15 and in the direction of outlet chamber 13. Within the latter, the first medium, which flows back, will be collected and will be discharged via the tube connector 11 connected to outlet chamber 13.

In the illustrated exemplary embodiment, the second tube 15 is configured as a double-walled tube and comprises an inner tube 15*b* and an outer tube 15*c*. The annular gap 15*d* formed between inner tube 15*b* and outer tube 15*c* is open toward inlet chamber 7. On the end 15*a* of second tube 15 facing away from outlet chamber 13, the inner tube 15*b* is connected to outer tube 15*c* so that the annular gap 15*d* is closed at this end. Such a configuration of the second tube 15 serves, on the one hand, as a radiation shield for the inner tube 15*b* while, on the other hand, first medium flowing into inlet chamber 7 will enter the annular gap between inner tube 15*b* and outer tube 15*c* and will remain there. This medium provides for an additional protective insulation effect. Thereby, the heat transfer can be rendered uniform.

The second section 5 of the heat exchanger 1 of the invention comprises an inlet means 19 and an outlet means 21. The inlet means 19 comprises an inlet tube connector 23 via which the second medium is supplied to heat exchanger 1. The outlet means 21 comprises an outlet tube connector 25 via which the second medium can flow out of the heat exchanger. In the exemplary embodiment shown in the Figures, the inlet tube connector 23 and the outlet tube connector 25 are arranged coaxially relative to each other.

The inlet means 19 opens into a heat exchanger chamber 27 which surround the first tubes 9 of first section 3. An elongated tube 27*a* surrounds the heat exchanger chamber 27. The second medium will flow through the inlet means 19 into the heat exchanger chamber 27 and thus surrounds the first tubes 9. On the surface of the first tubes 9, there is thus generated a heat transfer surface by means of which a heat exchange can be performed between the first and the second medium.

In the heat exchanger chamber 27, flow deflection elements 28 are formed which will effect a deflection of the flow direction of the second medium. In this manner, a heat exchange is enhanced. The flow deflection elements 28 can be designed in the form of ring or disk elements. The flow deflection elements 28 can be plates, e.g. deflection plates, or spiral-shaped deflection elements. By the arrangement of the flow deflection elements 28, the flow direction of the second medium is changed by way of a forced guidance of the second medium. Further, the amount of the pressure loss of the second medium when flowing through the heat exchanger chamber 27 is reduced.

At the end of heat exchanger chamber 27 facing away from the inlet means 19, the elongated tube 27*a* is open. A casing tube 29 surrounds the elongated tube 27*a* so that a gap space 31 is formed between the elongated tube 27*a* and the casing tube 29. Said gap space 31 merges into a second outlet chamber 33 which is a part of outlet means 21 and opens into outlet tube connector 25. At the end of casing tube 29 facing away from outlet means 21, casing tube 29 is connected to a casing separating wall 35 having the first tubes 9 passing through it. The casing separating wall 35 closes off the heat exchanger chamber 27 and the gap space 31 at the end facing away from outlet means 21. Thus, the second medium flowing through the heat exchanger chamber 27 will be deflected, by means of the casing separating wall 35, into the gap space 31 and will flow through the gap space 31 into the second outlet chamber 33.

From the inlet means 19, a bypass device 37 leads to the outlet means 21. In this arrangement, a bypass tube connector 39 is connected to inlet means 19 and extends into second outlet chamber 33. Thus, second medium which is flowing in through inlet means 19 can thus by conducted past the heat exchanger chamber 27 and flow directly to outlet means 21.

Further, the bypass device 37 in the exemplary embodiment shown in the Figures comprises a control device 43. By means of the latter, the pressure loss at the bypass device 37 can be controlled. This allows in a particularly advantageous manner for a control of the flow of the second medium through heat exchanger chamber 27 and bypass device 37. Thereby, control of the mixing temperature of the second medium at the outlet means 21 is rendered possible in an advantageous manner.

The inlet means 19 comprises a shut-off device 41 which, when viewed in the flow direction of the second medium, is arranged downstream of bypass device 37 within the inlet means 19. With the aid of said shut-off device, the fluid flow of the second medium into heat exchanger chamber 27 can be shut off. Thus, in the locking position of shut-off device 41, the second medium will flow completely through bypass device 37 into the outlet means 21. Shut-off device 41 makes it possible to perform an emergency switch-off, thus protecting the component parts within heat exchanger chamber 27.

The shut-off device 41 can also have a control function to the effect that a part of the second medium will flow into heat exchanger chamber 27 and a part will flow through bypass device 37. In this manner, the heat exchanger 1 can be controlled in an advantageous manner. Thus, the shut-off device 41 can perform a shut-off function and a control function, wherein, in some embodiments, the control device 43 can also be omitted.

The shut-off device 41 and the control device 43 can be designed e.g. as controllable flap. For instance, the shut-off device 41 and the control device 43 can comprise rotatingly driven flaps which are operative to delimit the throughflow in dependence on their position. The shut-off device 41 and the bypass device 37 are generally arranged separately from each other and are designed independently.

The heat exchanger 1 comprises a casing 45 accommodating the inlet chamber 7, the outlet chamber 13, the heat exchanger chamber 27, the gap space 31 and the second outlet chamber 33. In this arrangement, the casing 45 forms the casing tube 29 and the casing separating wall 35.

The inlet chamber and the outlet chamber are arranged in a first end section 45*a* of the casing. This end section can extend e.g. along 10-20% of the length of the entire casing 45.

The inlet means 19 and the outlet means 21 are arranged on a second end section 45*b* of the casing. As described, parts of inlet means 19 and of outlet means 21 are incorporated in this casing section. Also the second end section 45*b* of casing 45 extends along about 10-20% of the length of casing 45.

The central section 45*c* formed between the first and second end sections 45*a*, 45*b* accommodates the heat exchanger chamber 27 and forms the gap space 31.

The invention claimed is:

1. A heat exchanger comprising:

a first section through which a first medium can flow, and a second section through which a second medium can flow, wherein during operation a heat exchange takes place between the first and the second medium, wherein the first section comprises an inlet chamber and first tubes connected to the inlet chamber, and an outlet chamber and second tubes connected to the outlet chamber, wherein the first tubes are each closed at the ends facing away from the inlet chamber, and wherein each second tube is at least partly arranged inside one of the first tubes, and the end of each second tube that faces away from the outlet chamber is open to the interior of the respective first tube, wherein the second section comprises an inlet means and an outlet means, wherein the inlet means opens into a heat exchanger chamber and the heat exchanger chamber at least partly surrounds the first tubes of the first section, wherein the heat exchanger chamber is connected to the outlet means, wherein the inlet means comprises a shut-off device for shutting off the fluid flow of the second medium into the heat exchanger chamber, and that a bypass device connects the inlet means and the outlet means to lead the fluid flow of the second medium at least partly past the heat exchanger chamber, wherein the shut-off device is arranged downstream of the bypass device in the flow direction of the second medium.

2. The heat exchanger according to claim 1, wherein the bypass device comprises a control device for control of the fluid flow of the second medium through the bypass device.

3. The heat exchanger according to claim 1, wherein the shut-off device has a control function.

4. The heat exchanger according to claim 1, wherein the heat exchanger chamber is formed by an elongated tube.

5. The heat exchanger according to claim 4, wherein a casing tube surrounds the elongated tube of the heat exchanger chamber and that the casing tube opens into the outlet means, wherein, on the side facing away from the inlet means, the elongated tube is open toward a gap space formed between the casing tube and the elongated tube.

6. The heat exchanger according to claim 1, wherein by a casing in which the inlet chamber, the outlet chamber and the heat exchanger chamber are accommodated.

7. The heat exchanger according to claim 6, wherein the casing forms the casing tube.

8. The heat exchanger according to claim 6, wherein the inlet chamber and the outlet chamber are arranged in a first end section of the casing.

9. The heat exchanger according to claim 6, wherein the inlet means and the outlet means are arranged on a second end section of the casing.

10. The heat exchanger according to claim 6, wherein the heat exchanger chamber is arranged in a central section of the casing.

11. The heat exchanger according to claim 1, wherein the inlet means comprises an inlet tube connector and the outlet means comprises an outlet tube connector, wherein the inlet tube connector and the outlet tube connector are arranged coaxially to each other or their axes are arranged in a horizontal plane.

12. The heat exchanger according to claim 1, wherein the outlet means comprises a second outlet chamber, wherein the inlet means traverses the second outlet chamber and wherein the bypass device comprises a bypass tube connector extending from the inlet means into the second outlet chamber.

13. The heat exchanger according to claim 12, wherein the outlet tube connector opens into the second outlet chamber.

14. The heat exchanger according to claim 1, wherein each second tube is designed as a double-walled tube comprising an inner tube and an outer tube, wherein the inner tube and the outer tube are connected to each other on the end facing away from the outlet chamber or on the end facing toward the outlet chamber.

15. The heat exchanger according to claim 1, wherein in the heat exchanger chamber, flow deflection elements are arranged for deflecting the flow of the second medium.

* * * * *